United States Patent [19]

Morton et al.

[11] 4,075,117

[45] Feb. 21, 1978

[54] BUILT DETERGENT COMPOSITIONS

[75] Inventors: Edgar J. Morton, Brantford; Harold Donnan, Waterford, both of Canada; Arnold Wiesenfeld, Wyckoff, N.J.

[73] Assignee: Witco Chemical Corporation, New York, N.Y.

[21] Appl. No.: 723,511

[22] Filed: Sept. 15, 1976

Related U.S. Application Data

[63] Continuation of Ser. No. 410,648, Oct. 15, 1973, abandoned, which is a continuation of Ser. No. 140,556, May 5, 1971, abandoned.

[51] Int. Cl.[2] ..... C11D 1/12

[52] U.S. Cl. ..... 252/135; 252/527; 252/534; 252/537; 252/539

[58] Field of Search ..... 252/135, 527, 99, 138, 252/137, 539, 531, 534

[56] References Cited

U.S. PATENT DOCUMENTS

| | | | |
|---|---|---|---|
| 2,874,123 | 2/1959 | Schaafsma et al. | 252/99 |
| 3,444,086 | 5/1969 | Hilton et al. | 252/138 |
| 3,459,670 | 8/1969 | Carter | 252/99 |
| 3,590,001 | 6/1971 | Taylor et al. | 252/137 |
| 3,634,269 | 1/1972 | Anderson | 252/531 |
| 3,838,072 | 9/1974 | Smith et al. | 252/527 |

OTHER PUBLICATIONS

Kramer, *Builders for Detergents,* J. of American Oil Chemists Soc., Nov. 1952, pp. 529–534.

McCutcheon, *Synthetic Detergents,* Mac-Nair Dorland Co., N. 1950, p. 250.

Synthetic Detergents, Davidsohn, Leonard Hill London, 1967, pp. 140 and 150.

*Primary Examiner*—Thomas J. Herbert, Jr.

*Attorney, Agent, or Firm*—Albert L. Gazzola; Morton Friedman

[57] ABSTRACT

Dry powder laundry detergent compositions which contain an anionic, nonionic, ampholytic or zwitterionic synthetic detergent, a sodium carbonate, bicarbonate or sesquicarbonate, amorphous sodium silicate and sodium sulfate, used in certain ranges of proportions.

6 Claims, No Drawings

BUILT DETERGENT COMPOSITIONS

This is a continuation of application Ser. No. 410,648, filed Oct. 15, 1973, abandoned; which is a continuation of Ser. No. 140,556 filed May 5, 1971, abandoned.

This invention relates to improved built dry powder laundry detergent compositions which are free or essentially free from inorganic condensed phosphate builders such as the polyphosphates and pyrophosphates of alkali metals, and which, nevertheless, function highly effectively as laundering agents.

The water-soluble alkali metal inorganic condensed phosphates have long been recognized as being highly effective components of laundry detergent compositions. They perform a variety of functions, acting as sequestering agents for ions such as calcium, magensium, and iron, which cause hardness in water, and as dispersing and soil suspension agents. Such phosphates also serve to improve surfactant efficienty and maintain the desired alkalinity for the washing solution. These phosphates have generally been present in an amount ranging from 20 to 60%, usually from 35 to 50% by weight of the detergent compositions.

The use of these phosphates has been cited as a cause of adverse environmental effects in that the phosphates assertedly accelerate the growth of aquatic plants, mainly algae, resulting in an increase in the numbers of dead plants at the end of the life cycle thereby reducing the available oxygen supply in the bodies of water so affected. Phosphate-free detergent formulations are therefore highly desirable and are essential for some localities due to legislative enactments restricting the sale or use of phosphate-containing detergent compositions.

Unfortunately, the formulation of detergent compositions whose effectiveness approaches or equals that of the phosphate-built compositions have presented marked difficulties. The present invention presents an effective solution to such difficulties.

There have been prior art disclosures of certain detergent formulations containing very minor amounts of phosphates or formulations containing no phosphates and certain proportions of inorganic silicates, carbonates, bicarbonates and/or sulfates such as are disclosed, for example, in U.S. Pat. Nos. 2,298,696; 2,350,592; 2,365,215 and 2,874,123. However, such prior art fails to suggest the particular compositions in the proportions more fully described herein and the surprising laundering efficiency of such compositions.

In accordance with this invention, there have been discovered improved dry powder detergent compositions comprising the following essential ingredients in the following percentages, by weight:

(a) from 5 to 25%, preferably 15 to 20%, of a water-soluble anionic, nonionic, ampholytic or zwitterionic synthetic detergent or compatible mixtures of two or more thereof;

(b) from 10 to 25%, preferably 10 to 15%, amorphous, water-soluble sodium silicate having an $Na_2O:SiO_2$ ratio of 1:1 to 1:3;

(c) from 10 to 50%, preferably 25 to 35%, of a member selected from the group consisting of sodium carbonate, sodium bicarbonate, sodium sesquicarbonate and mixtures of same; and (d) from 25 to 60%, preferably 35 to 45%, sodium sulfate.

It has been found that despite the absence of condensed phosphate builders, the formulations disclosed herein exhibit effects which are most surprising, since the compositions of the present invention contain a combination of amorphous sodium silicate and sodium carbonate, bicarbonate or sesquicarbonate, which compounds have long been considered as merely supplementary ingredients of detergent compositions and not as having the capacity to efficiently serve a primary function as the principal builder ingredient.

The synthetic detergent employed in the compositions of the present invention may be chosen from a wide variety of anionic, synthetic detergents. Suitable anionic detergents generally comprise the water-soluble, particularly the alkali metal, sulfates and sulfonates containing an alkyl radical having from 8 to 22 carbon atoms. Exemplary are the sodium and potassium alkyl sulfates, especially those obtained by sulfating a $C_8$ to $C_{18}$ aliphatic alcohol; sodium and potassium alcohol ether sulfates which are derived from the reaction product of 1 mol of a higher $C_{12}$ to $C_{18}$ fatty alcohol with about 1 to 6 mols of ethylene oxide; the sodium and potassium salts of sulfonated $C_{10}$ to $C_{24}$ alpha-olefins; the alkyl glyceryl ether sulfonates, particularly ethers of tallow and coconut oil alcohols; the sodium and potassium salts of alkyl benzene sulfonic acids wherein the alkyl group is a linear alkyl having from 8 to 18 carbon atoms, and most suitably from about 10 to 16 carbon atoms, the latter alkyl benzene sulfonates being the particularly preferred synthetic detergent for use in the composition of the present invention, especially in proportions of 17 to 18%.

The sodium silicate employed in the composition of the present invention is the water-soluble, noncrystalline, amorphous form of sodium silicate having a $Na_2O:SiO_2$ ratio of between 1:1 and 1:3, and preferably in the range of 1:2 to 1:3. Sodium silicate will comprise 10 to 25%, by weight, and preferably, from 10 to 15%, by weight of the overall composition.

Sodium carbonate, bicarbonate or sesquicarbonate are employed within the range of 10 to 50%, by weight, and preferably within the range of about 25 to 35% by weight of the overall composition. Generally sodium carbonate alone is used since spray drying temperatures tend to cause decomposition of the bicarbonate or sesquicarbonate; however, these forms may be used as such or in admixture with sodium carbonate when drum drying or dry blending procedures are used and equivalent results are the rule.

The final essential component in the compositions of the present invention is sodium sulfate which may be present in an amount ranging from about 25 to 60%, and preferably from 35 to 45% by weight of the overall composition.

While compositions consisting essentially of the aforesaid essential components in the proportions described in themselves are superior laundry detergent compositions and exhibit superior washing performance, further embodiments of the present invention reside in compositions containing, as additional supplementary builder ingredients, minor proportions, in the range of about 2 to 10% by weight, of lower molecular weight carboxylate builder salts or sequestering agents, particularly those containing a hydroxy, nitrilo or amino substituent group and having from 2 to 4 carboxylate groups, said carboxylate salts and sequestering agents being disclosed by Davidson & Milwidsky in "Synthetic Detergents" (Leonard Hill Books, London:1967) at p. 57–59, as exemplified by sodium tartrate, sodium citrate (2-hydroxy-1,2,3-propane tricarboxylate, sodium nitrilotriacetate, sodium N-(2-hydroxyethyl)-nitrilodiacetate, sodium ethylenediaminetetraacetate and the like. The compositions of the present invention containing the aforesaid essential components exhibit excellent compatibility with the aforesaid carboxylate builder salts and sequestering agents, and incorporation of these carboxylates in minor amounts with the aforesaid principal components results in detergent blends having enhanced soil suspension properties and assures more uniform washing performance over a wide range of synthetic and natural fabrics.

There also may be included in the compositions of the present invention various supplemental and special purpose additives in very minor proportions, generally not in excess, totally, of about 10% by weight of the finished composition. Exemplary are auxiliary cleaning agents such as sodium borate, bleaches such as the perborates, fluorescent whitening agents, soil redeposition inhibitors such as carboxymethyl cellulose, bacteriostats, bluings, colorings, tarnish inhibitors and the like. Also includible are enzymes and enzymatic compositions such as are disclosed in U.S. Pat. No. 3,519,570, antitack additives such as sodium sulfosuccinate, sodium silicoaluminate and the like. Particularly preferred special purpose additives are sodium borate and sodium carboxymethyl cellulose employed, each, in amounts ranging between 0.5 and 5%, the optimum range being from 2 to 3%.

The above described formulations function surprisingly well and are especially suitable detergent compositions for home laundry use. The various indicia of washing performance indicate that they are reasonably comparable or substantially equivalent to heretofore used phosphate built dry powder detergent compositions.

The formulations disclosed herein are prepared utilizing conventional techniques such as forming a slurry of the ingredients and spray drying to form a detergent bead. The compositions of the present invention after spray drying, exhibit good bead strength and flow properties.

The invention is further illustrated by the following examples which are not to be considered as limitative of its scope. Percentages stated are by weight.

EXAMPLE 1

A spray dried formulation is prepared composed of the following:

| | | |
|---|---|---|
| (a) | Sodium n-dodecylbenzene sulfonate | 17.5% |
| (b) | Amorphous sodium silicate ($Na_2O:2.4SiO_2$) | 12.0% |
| (c) | Sodium carbonate | 30.0% |
| (d) | Sodium sulfate | 34.5% |
| (e) | Carboxymethyl cellulose | 2.5% |
| (f) | Fluorescent whitening agent | 0.5% |
| (f) | Moisture | 3.0% |

This composition is prepared by forming first an aqueous slurry of all ingredients and thereafter spray-drying the slurry to form the finished composition.

EXAMPLE 2

A spray dried granular composition is prepared according to the procedure of Example 1, and is composed of the following ingredients:

| | | |
|---|---|---|
| (a) | Sodium n-dodecylbenzene sulfonate | 17.0% |
| (b) | Amorphous sodium silicate ($Na_2O:2.4SiO_2$) | 12.0% |
| (c) | Sodium carbonate | 28.0% |
| (d) | Sodium borate | 2.0% |
| (e) | Sodium ethylenediaminetetraacetate | 2.0% |
| (f) | Carboxymethyl cellulose | 0.5% |
| (g) | Sodium sulfate | 35.0% |
| (h) | Fluorescent whitening agent | 0.5% |
| (i) | Moisture | 3.0% |

EXAMPLE 3

The following is representative of commercially available phosphate-built formulations, and is set forth for comparative purposes:

| | | |
|---|---|---|
| (a) | Sodium n-dodecylbenzene sulfonate | 17.5% |
| (b) | Sodium silicate | 4.5% |
| (c) | Sodium tripolyphosphate | 48.0% |
| (d) | Fluorescent whitening agent | 0.5% |
| (e) | Carboxymethyl cellulose | 1.0% |
| (f) | Sodium sulfate | 25.5% |
| (g) | Moisture | 3.0% |

In order to evaluate the washing performance of the compositions, duplicate Terg-O-Tometer tests were carried out in accordance with the conditions of temperature and water hardness recommended by the ASTM-D12 Committee on Consumer Standards for Laundry Products. The wash loads employed standard soil swatches supplied by American Conditioning House (ACH), U.S. Testing Co., Testfabric, Inc. and swatches containing a simulated soil as described by Sanders and Lambert in the Journal of the American Oil Chemists Society, Vol. 5, No. 27, p. 156 (1950). The wash cycle consisted of a 15 minute wash with the detergent solution at 40° C., or 55° C., at 100 r.p.m. followed by a 1 minute rinse at 100 r.p.m. in water of the same hardness as the detergent solution and electric drying and ironing. 2.5 grams of detergent composition was used per liter of water. Tabulated below are the results in terms of percentage soil removal.

TABLE 1

| Fabric | Soil Removal Data | | | |
|---|---|---|---|---|
| | Example 1 | | Example 3 | |
| Testfabric, Inc. | 40° C. | 55° C. | 40° C. | 55° C. |
| 50 ppm | 46.1% | 42.5% | 48.0% | 45.3% |
| 200 ppm | 50.6% | 45.8% | 47.6% | 44.3% |
| ACH | | | | |
| 50 ppm | 69.4% | 64.5% | 68.0% | 64.9% |
| 200 ppm | 60.8% | 58.0% | 66.3% | 64.4% |
| U.S. Testing Co. | | | | |
| 50 ppm | 23.3% | 22.6% | 26.0% | 23.2% |
| 200 ppm | 23.9% | 20.8% | 23.8% | 23.7% |

These data indicate that the compositions of the present invention, as represented by Example 1, perform in a manner reasonably equivalent to presently marketed phosphate-built detergent compositions, as represented by Example 3.

In Table 2 below is set forth comparative Terg-O-Tometer soil removal data for the compositions of Examples 2 and 3.

TABLE 2

| Fabric | Soil Removal Data | |
|---|---|---|
| | Example 2 | Example 3 |
| U.S. Testing Co. | 55° C. | 55° C. |
| 50 ppm | 18.3% | 24.7% |
| 200 ppm | 17.5% | 25.3% |
| ACH | | |

TABLE 2-continued

| Fabric | Soil Removal Data Example 2 | Example 3 |
|---|---|---|
| U.S. Testing Co. | 55° C. | 55° C. |
| 50 ppm | 68.8% | 66.7% |
| 200 ppm | 62.0% | 65.4% |
| Sanders & Lambert | | |
| 50 ppm | 41.4% | 40.8% |
| 200 ppm | 35.3% | 39.8% |

EXAMPLE 4

A spray dried formulation is prepared as in Example 1 and is composed of the following ingredients:

| | |
|---|---|
| (a) Sodium n-dodecylbenzene sulfonate | 17.5% |
| (b) Amorphous sodium silicate ($Na_2O:2.4SiO_2$) | 12.0% |
| (c) Sodium carbonate | 30.0% |
| (d) Sodium nitrilotriacetate | 10.0% |
| (e) Sodium sulfate | 26.5% |
| (f) Fluorescent whitening agent | 0.5% |
| (g) Carboxymethyl cellulose | 0.5% |
| (h) Moisture | 3.0% |

Terg-O-Tometer soil removal data for this detergent composition is given below in Table 3.

TABLE 3

| Fabric | Soil Removal Data Example 4 |
|---|---|
| Testfabric, Inc. | 55° C. |
| 200 ppm | 42.1% |
| ACH | |
| 200 ppm | 53.2% |
| U.S. Testing Co. | |
| 200 ppm | 20.3% |

The following are additional illustrative examples of the compositions of the present invention.

| | |
|---|---|
| (a) Sodium n-dodecylbenzene sulfonate | 10.0% |
| (b) Sodium silicate | 18.0% |
| (c) Sodium carbonate | 10.0% |
| (d) Sodium bicarbonate | 18.0% |
| (e) Sodium citrate | 5.0% |
| (f) Sodium sulfate | 35.0% |

-continued

| | |
|---|---|
| (g) Carboxymethyl cellulose | 1.0% |
| (h) Moisture | 3.0% |

| | |
|---|---|
| (a) Sodium tallow alkyl sulfate | 20.0% |
| (b) Sodium silicate | 20.0% |
| (c) Sodium carbonate | 30.0% |
| (d) Sodium sulfate | 25.0% |
| (e) Sodium borate | 2.0% |
| (f) Moisture | 3.0% |

What is claimed is:

1. An improved built dry powder laundry detergent composition in the form of spray dried beads consisting essentially of the following ingredients in the following ranges of percentages by weight:

(a) from 15 to 20% of a sodium linear alkyl benzene sulfonate detergent;

(b) about 12% amorphous water-soluble sodium silicate having an $Na_2O:SiO_2$ ratio between about 1:2 and 1:3;

(c) from 25 to 35% of a member selected from the group consisting of sodium carbonate, sodium bicarbonate, sodium sesquicarbonate and mixtures of same; and (d) from 25 to 45% sodium sulfate.

2. A composition according to claim 1 wherein said sodium linear alkyl benezene sulfonate, the alkyl thereof having from 8 to 18 carbon atoms.

3. A composition according to claim 1 wherein said (c) ingredient is sodium carbonate.

4. A composition according to claim 1 having as an additional ingredient included therein from 2 to 10% by weight of a lower molecular weight carboxylate builder salt selected from the group consisting of sodium tartrate, sodium citrate, sodium nitrilotriacetate, sodium N-(2-hydroxy ethyl)-nitrilodiacetate and sodium ethylenediaminetetraacetate.

5. A composition according to claim 1 having as an additional ingredient included therein from 0.5 to 5% by weight of sodium borate.

6. A composition according to claim 1 having as an additional ingredient included therein from 0.5 to 5% by weight of sodium carboxymethyl cellulose.

* * * * *